US005913342A

United States Patent [19]

McGill

[11] Patent Number: 5,913,342

[45] Date of Patent: Jun. 22, 1999

[54] DEFORMABLE CONTAINER

[75] Inventor: Shane R. McGill, Kent, United Kingdom

[73] Assignee: McGill Technology Limited, United Kingdom

[21] Appl. No.: 08/945,627

[22] PCT Filed: Apr. 29, 1996

[86] PCT No.: PCT/GB96/01010

§ 371 Date: Oct. 30, 1997

§ 102(e) Date: Oct. 30, 1997

[87] PCT Pub. No.: WO96/34803

PCT Pub. Date: Nov. 7, 1996

[30] Foreign Application Priority Data

May 3, 1995 [GB] United Kingdom ..... 9508981

[51] Int. Cl.[6] ..... B65B 1/04

[52] U.S. Cl. ..... 141/1; 141/114; 141/313

[58] Field of Search ..... 141/1, 2, 114, 141/313; 222/95, 206, 215, 386.5

[56] References Cited

U.S. PATENT DOCUMENTS 3,289,891 12/1966 Frankenberg .

3,390,821 7/1968 Mullan ..... 222/215

5,333,761 8/1994 Davis et al. .

FOREIGN PATENT DOCUMENTS 0 144 925 6/1985 European Pat. Off. .

2576876 8/1986 France .

*Primary Examiner*—David J. Walczak

*Attorney, Agent, or Firm*—Nixon & Vanderhye

[57] ABSTRACT

A deformable container is provided which is especially intended for dispensing semi-solid product. It has two end walls at opposite ends and in one end wall is provided an opening through which product is dispensed from he container. The side wall of the container is formed in the manner of a concertina by the provision of pleats and the widths of the pleats differs over the length of the container being greater over the pleats adjacent the end wall having the outlet compared with the depth adjacent the opposite end wall. The invention also provides a method of filling the container in which the container is initially fully deformed and product enters through the opening and causes the container to move towards its extended position.

5 Claims, 3 Drawing Sheets

Figure 1:
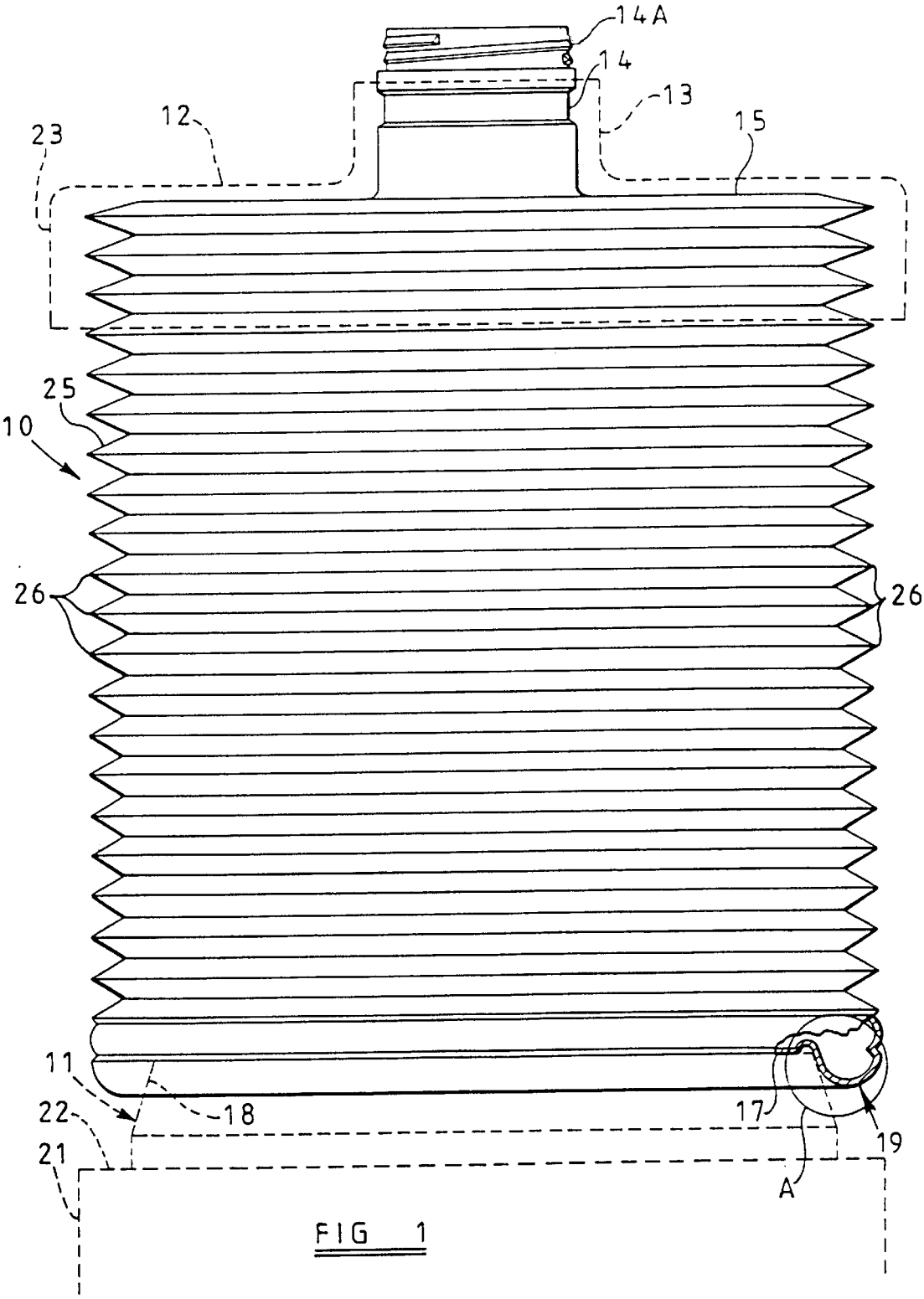

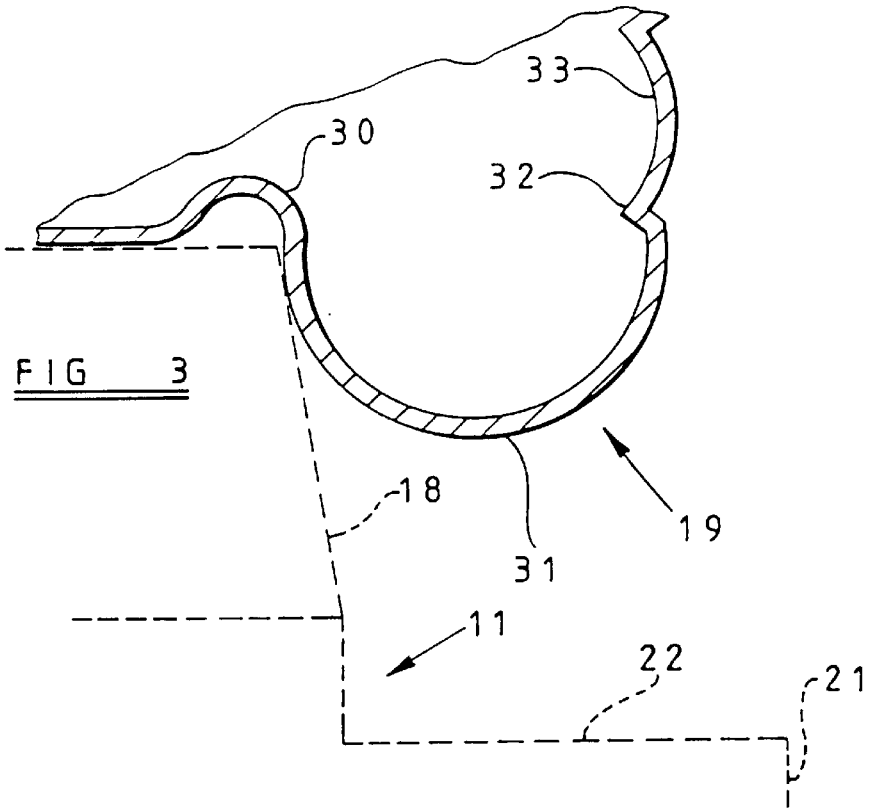
FIG 3
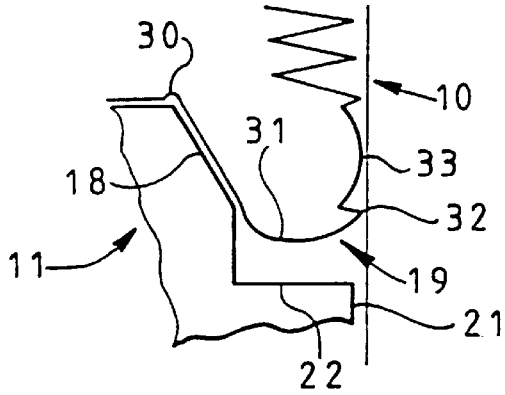
FIG 4
FIG 5
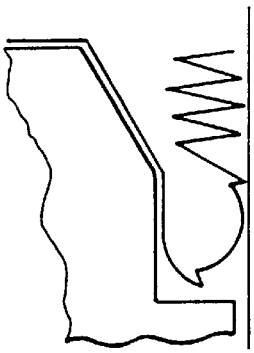
FIG 6
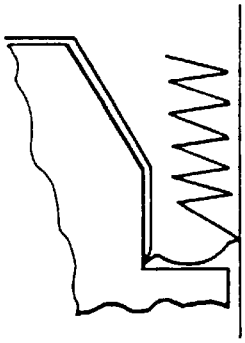
FIG 7
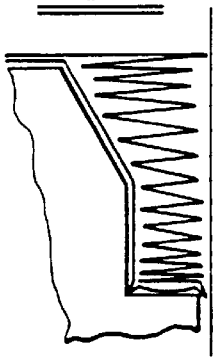

DEFORMABLE CONTAINER

This invention relates to deformable containers in particular containers for use in dispensing machines, the containers being intended to be deformed to discharge the contents thereof.

Deformable containers have been proposed which are of generally cylindrical shape having end walls at opposite ends, one end wall including an opening and the other end wall being arranged to be engaged to move the end walls relative to one another. During such movement the side walls are deformed and the side walls may have a concertina-like formation to enable deformation to take place to reduce the length and volume of the container and discharge the contents of the container. With the concertina-like formation the side wall may comprise a plurality of pleats which close up and open out during deformation of the container.

When the contents of the container are viscous or semi-solid it is important that the internal volume of the container is reduced to a minimum upon full discharge of the container, to ensure that the contents are substantially eliminated from the container.

An object of the invention is to provide an improved deformable container.

According to the invention a deformable container of generally cylindrical shape comprises end walls at opposite ends, one end wall including an opening and the other end wall being arranged to be engaged to move said other end wall relative to said one end wall to deform the side walls, the side walls having a concertina-like formation whereby the side walls deform upon said movement to reduce the length of the container, wherein the side walls comprise a plurality of pleats and the depth of the pleats differs over the length of the container.

Conveniently the depth of the pleats is greater towards the end of the container having said one end wall and said opening. In one arrangement said other end wall of the container is provided with a central portion to be engaged by a plunger for moving the end walls towards one another and an outer portion of said other end wall between said central portion and the concertina-like formation, said outer portion being flexibly arranged to permit the plunger to move initially along the container towards said one end and relative to the side wall to take up a position within said side wall without substantial deformation of said side wall. Such movement, upon continuation, causes deformation of the concertina-like formation.

Preferably the outer portion is of curvilinear shape and is outwardly convex before deformnation.

Conveniently there is provided a notch or kink in said outer portion which, upon deformation of said portion, engages a shoulder on said plunger.

Although the container is described as cylindrical it may take other forms such as eliptical, rectangular with rounded corners, or other curvilinear shapes.

The invention also provides a method of filling and discharging deformable containers of the kind described above in which the container is initially deformed so that its internal volume is reduced, preferably to a minimum, admitting product into the container through said opening while the container is deformed to increase its internal volume, continuing filling the container until it is substantially full of product, the container then being dischargeable by engaging the end of the container remote from the opening to deform the container to reduce its internal volume, and discharge product from said opening.

In the method of the invention a product discharge nozzle may be sealingly engaged over the opening so that as the volume of the container is increased the product admitted to the container completely occupies the increased space within the container. Preferably the container at the commencement of filling with product is substantially completely deformed to a position in which there is minimum volume within the container and deformation to increase its internal volume is resisted. In this way the container is filled with product with a minimum entrapment of air within the container and with a rapid filling rate.

Figure 2:
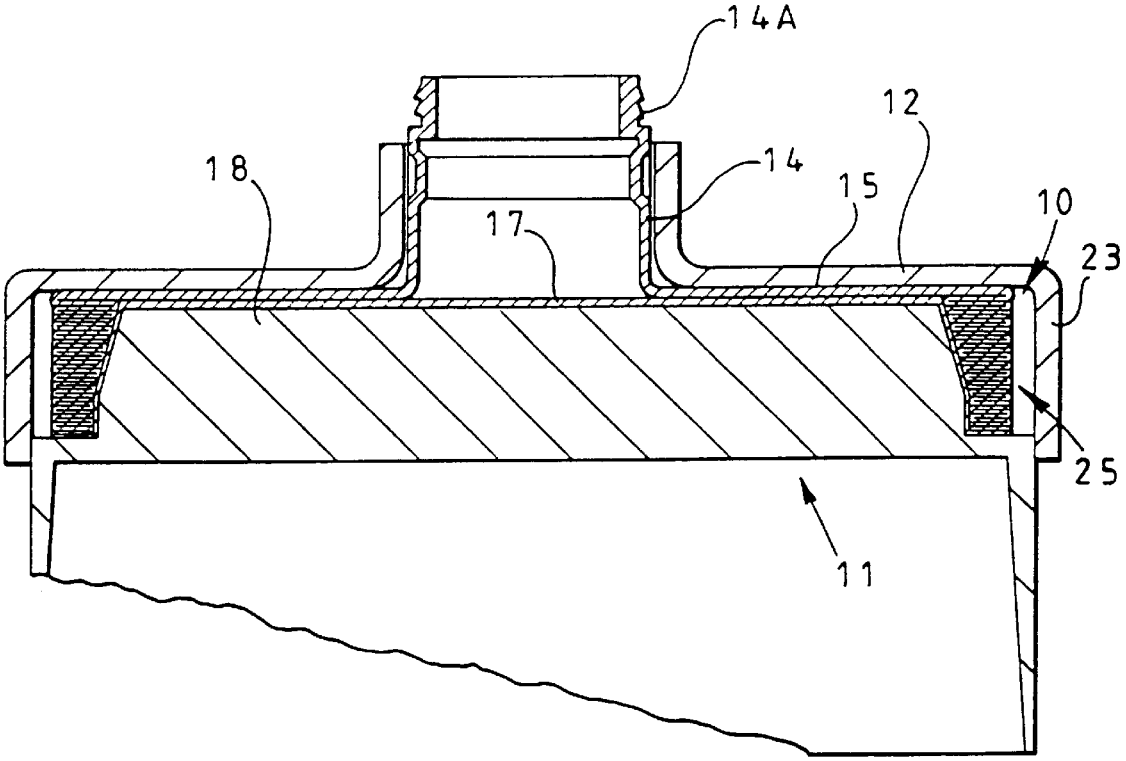

Further features of the invention will appear from the following description of an embodiment of the invention given by way of example only and with reference to the drawings, in which:

FIG. 1 is a side elevation of a deformable container, FIG. 2 is a cross-section of the container of FIG. 1 in its fully deformed position, incorporated in a container discharge/filling apparatus, FIG. 3 shows an enlarged view of the container over the region A of FIG. 1 and FIGS. 4,5,6 and 7 show the part of the container of FIG. 3 as the container is deformed during discharge.

Referring to the drawings and firstly to FIG. 1 there is shown a cylindrical container 10 in its fully extended position, i.e. with maximum internal volume. In FIG. 1 the container 10 is shown engaged at one end by a plunger or piston 11 and at the other end located against an abutment 12 in which is formed an opening 13 through which extends an outlet tube 14 of the container 10. The outlet tube 14 is formed at one end of the container 10 in an end wall 15 which extends generally at a right angle to the axis of the container 10. At the opposite end of the container 10 is formed an end wall 17 which, as shown, is recessed into the container and is engaged by a head portion 18 of the plunger 11, the portion 18 tapering inwards and having a flat end engageable with the end wall 17 which is also has a substantially flat portion which is located centrally of the container 10.

The end wall 17 engaged by the plunger 11 has a portion 19 extending around the central flat portion of the end wall 17 which is of a shape more clearly shown in FIG. 3. The plunger 11 has a further cylindrical head portion 21 defining between it and the portion 18 a shoulder 22. The abutment plate 12 defines a cylindrical portion 23 extending towards the plunger 11 over a distance such that when the container 10 is fully deformed the portion 21 of the plunger enters the lower end of the cylindrical portion 23 of the abutment 12, as shown in FIG. 2.

A cylindrical side wall 25 of the container is formed with a plurality of pleats 26 arranged along the full length of the container 10, the pleats 26 being opened out to the position shown in FIG. 1 in the fully extended position of the container and being closeable up to the position shown in FIG. 2 when the container has its minimum internal volume, the container side wall acting in the manner of a concertina.

The outer peaks of the pleats 26 lie on a substantially constant diameter cylinder but the radially-directed extent or width of the pleats is different over the length of the container 10. Thus the pleats 26 have a minimum width towards the end of the container to be engaged by the plunger 11 and at the opposite end of the container 10 the pleats 26 have a greater width. As shown in FIG. 1 several of the pleats 26 nearest to the end wall 17 are of the same width then, as the pleats get progressively closer to the end wall 15, the widths of the pleats progressively increases, as shown in FIG. 1. It will appear from FIG. 2 that the increasing width of the pleats towards the end wall 15 accommodate the taper of portion 18 of the plunger 11. Moreover in the fully deformed position of the container 10 the end wall 17 of the container lies closely adjacent to the opposite end wall 15 and with the plunger 11 fully compressed the plunger lies adjacent the inner sides of the pleats 26. If required the outer diameter of the pleats 26 can be different in particular the pleat 26 adjacent the end wall 15.

Referring now to FIG. 3 the outer portion 19 of the end wall 17 connected to the side wall 25 is of generally curvilinear shape. More particularly the portion 19 has a shape which, adjacent the flat end wall 17, is initially arcuate and concave, and of small radius at 30. A larger radius arcuate and outwardly convex portion 31 follows, succeeded by a notch or kink 32 and a further arcuate and outwardly convex portion 33. The shaping of the portion 19 is intended to bring about progressive deformation of the container 10, upon engagement by the plunger 11 in the manner shown in FIGS. 3–7 which are self explanatory. As a result of the shape of the portion 19, the plunger 11 enters the container 10 and moves into the container before any substantial compression of the pleats 26 at that end of the container takes place.

During this movement the central portion 17 of the end wall moves upwardly (as seen in FIG. 1) and the flexible outer portion 19 flexes so that the part 30 of the portion is located at the outer corner of the plunger and the kink 32 engages into the shoulder 22 of the plunger. Thereafter compression of the pleats adjacent that end of the container takes place in the region above the shoulder 22.

After the container, during a discharge stroke of the plunger 11, has taken up the position shown in FIG. 7 continued movement of the plunger in FIG. 7 causes the pleats 26 along the length of the container to be closed up until at the completion of a stroke, the container takes up the position shown in FIG. 2 in which the product is fully discharged from the container through the opening defined by outlet tube 14, leaving product only within the tube 14. At this position the corrugations or concertina portions of the side wall of the container are located between the head 18 of the plunger 11, the shoulder 22 of the plunger 11 and the inside wall of the cylindrical portion 23 of the abutment plate 12. The wall 17 at one end of the container 10 is closely adjacent or in contact with the end wall 15 at the other end of the container.

In filling the container 10, the container may initially be fully compressed in an empty condition to the position shown in FIG. 2. The tube 14 is sealingly connected to a discharge duct for product (not shown) so that product may enter the container in through the tube 14 without any ingress of air. As product is discharged into the tube 14 the wall 17 of the container is pushed away from the tube 14 towards an extended position, such movement being in accordance with the amount of product entering the container. Such movement is normally by pressure of product entering the container with or without an abutment, similar to the plunger 11 engaging the container to provide resisted movement to entry of product.

During filling of the container 10 means may be provided for ensuring that the container is filled with a predetermined quantity of product. This may be any one or more of the following controls. The container may be filled until it has reached a predetermined length, filled for a predetermined period, filled with a predetermined weight or with a predetermined volume of product. Filling machines often aerate the product before or during filling and a measure of the adequacy of the aeration achieved can be made during filling by measuring the volume of product in the container and comparing it with the weight. Suitable measuring means determining the position and weight of the container and the filling time may be utilized for this purpose.

When the container 10 is filled with product the product discharge duct is disconnected from the tube 14 and a closure member (not shown) is screwed onto the outer end of the duct 14, this being screw-threaded as at 14A. The filled container may then be heat treated by freezing and transported to a point of use location at which the product may be discharged in a dispensing machine which may be of the kind described in British Patent specifications number 2213532.

The invention provides an improved container and method of use thereof by which utilization of the container is improved, product wastage is reduced and filling efficiency is enhanced.

I claim:

1. A deformable container of generally cylindrical shape which comprises end walls at opposite ends, a side wall extending between the end walls, one end wall including an opening and the other end wall being arranged to be engaged whereby such engagement moves said other end wall relative to said one end wall to deform the side wall, the side wall having a concertina-like formation whereby the side wall deforms upon said movement to reduce the length of the container, wherein the side wall comprises a plurality of pleats and the radially directed extent of the pleats differs longitudinally of the container, the pleats having radial inner edges and radial outer edges, said other end wall of the container being provided with a central portion arranged to be engaged by a plunger for moving the end walls towards one another, and with an outer portion of said other end wall between said central portion and the concertina-like formation, said outer portion being flexibly arranged to permit the plunger to move initially along the container towards said one end wall and relative to the side wall to take up a position within said side wall without substantial deformation of said side wall, further movement of the plunger deforming the side wall.

2. A deformable container according to claim 1 wherein the depth of the pleats is greater towards the end of the container having said one end wall and said opening.

3. A deformable container according to claim 1 wherein said outer portion is of curvilinear shape and is outwardly convex before deformation.

4. A deformable container according to claim 1, comprising a notch in said outer portion which, upon the formation of said portion, engages a shoulder on said plunger.

5. A deformable container according to claim 1, wherein the central portion and the outer portion of said other end wall, and the side wall of the container adopt a position during a deformation in which the outer portion is tapered outwardly to generally conform in shape to the deformed shape of the side wall at radial inner edges of the pleats.

* * * * *